United States Patent [19]

Williams et al.

[11] Patent Number: 4,695,703

[45] Date of Patent: Sep. 22, 1987

[54] FLEXIBLE BLANKET HEATER

[75] Inventors: David E. Williams; Edwin D. Hoyt, both of Hemet, Calif.

[73] Assignee: Amark Industries, Inc., San Jacinto, Calif.

[21] Appl. No.: 855,925

[22] Filed: Apr. 25, 1986

[51] Int. Cl.[4] ..... H05B 3/36

[52] U.S. Cl. ..... 219/212; 219/528; 219/549

[58] Field of Search ..... 219/200, 201, 212, 213, 219/527, 528, 529, 548, 549, 211

[56] References Cited

U.S. PATENT DOCUMENTS

| | | | |
|---|---|---|---|
| 2,900,290 | 8/1959 | Bethge | 219/528 |
| 3,153,140 | 10/1964 | Theodore | 219/345 |
| 3,687,143 | 8/1972 | Schneeberger | 219/211 |
| 4,293,763 | 10/1981 | McMullan | 219/212 |

FOREIGN PATENT DOCUMENTS

| | | | |
|---|---|---|---|
| 911744 | 11/1962 | United Kingdom | 219/213 |
| 2061079 | 5/1981 | United Kingdom | 219/548 |

*Primary Examiner*—E. A. Goldberg
*Assistant Examiner*—Teresa J. Walberg
*Attorney, Agent, or Firm*—Georges A. Maxwell

[57] ABSTRACT

An improved flexible blanket heater includes a thin, normally flat flexible blanket of elastic dielectric material having a high modulus of elasticity and defining top and bottom surfaces. An elongate flexible resistance element of an alloy having a lower modulus of elasticity than said dielectric material and positioned within and arranged to extend about and throughout the plane of the blanket. The blanket has welts at its top and bottom surfaces adjacent and coextensive with the element. The welts establish curved compacted element supporting masses about the inside circumference of the element when the blanket is bent and which serve to limit bending of the element to radii at which the modulus of elasticity of the element is not exceeded. The blanket includes flexible fabric reinforcements at its surfaces which prevent free elastic flow and displacement of the dielectric material and assure compacting of that material about the inside circumference of bends at the welts.

6 Claims, 8 Drawing Figures

FLEXIBLE BLANKET HEATER

BACKGROUND OF THE INVENTION

Throughout the industrial arts, there are numerous instances where heat must be applied to work and such heat is most effectively and efficiently applied to the work by flexible electric resistance blanket heaters. For example, in the course of fabricating fluid conducting systems of polyvinylchloride tube stock or pipe, it is often required that sections of the pipe be bent. The bending of such pipe is commonly achieved by engaging a flexible blanket heater about the portion of the pipe to be bent and the plastic material of the pipe is heated to about 300° F., at which temperature it becomes sufficiently plastic to be manually bent, as desired. In such a case, after the pipe is suitably heated, bent, the heater is removed from the pipe and the pipe is suitably bent.

Blanket heaters for the above particular use and for most other special uses must often be extremely flexible to enable them to be effectively engaged with their related work, must be capable of being heated up and cooled rapidly in order to conserve of both electric current and time; and must be capable of being repeatedly wrapped, unwrapped, bent, twisted and otherwise worked throughout as long a service life as can be afforded.

In the art of industrial blanket heaters of the general character referred to above and here concerned with, the most effective, efficient and dependable resistance elements are multi-strand wire elements twisted in a gentle helix to allow for limited elongation to relieve tension and being repeatedly flexed and closely bent, back and forth without stretching and and to minimize hardening of the strands or filaments of which they are made.

The most common prior art industrial blanket heater structure of the type or class here concerned with are established by arranging the twisted wire elements in predetermined patterns (serpentine, zig-zag or the like) between a pair of sheet-like laminates of flexible, elastic, dielectric material and bonding, fusing or welding the laminates together with the wire element held captive therebetween. To impart such heater structures with desired flexibility and to reduce their mass so as to increase the rate at which they heat up and cool off, laminates are used to establish the thinnest and most flexible blanket structures possible, with practical limits. The thickness, mass and flexibility of such prior art blanket heaters is, however, greatly and/or critically limited by the flexibility of the wire resistance elements thereof. That is, the laminated blankets within which the resistance elements are engaged must be sufficiently thick and/or stiff to prevent the resistance elements within them from being so tightly bent that the strands of the elements are drawn beyond their elastic limits and caused to kink within the heater structures as they are flexed and worked. When a strand or two of resistance elements of the character here concerned with are drawn and kinked within their related blanket structures, the kinks establish fulcrums or bending points in the elements at which all subsequent bending and working of the adjacent portions of the blanket structures tend to concentrate and which results in rapid work-hardening and breaking of the elements and premature self-destruction of the heater structures.

As a result of the foregoing, the practical thickness and resulting mass of the blanket structure of industrial blanket heaters is often a compromise between optimum flexibility, optimum minimum mass and that structural stiffness that must be afforded for the resistance elements in order to prevent drawing or stretching of the elements and resulting kinking and premature working thereof. As a result of the above noted compromise, in a large percentage of industrial heaters that are made sufficiently thin and flexible to minimize their mass and increase their heating and cooling rate and/or to enhance their capacity to conform with related work, the resistance heating elements are highly subject to kinking, work-hardening and breaking, the heaters are inherently short-lived and undependable. In such heaters that are made sufficiently thick and/or stiff to afford adequate support for and prevent stretching, kinking and premature work-hardening of the resistance elements, though more dependable and generally longer lived, are slow to heat and cool and are therefore notably less efficient and economical to use and are frequently too stiff and bulky to effectively conform with related work.

As a result of the foregoing, the great majority of those industrial blanket heaters which are subject to being repeatedly and/or continuously manually manipulated and worked are, at best, comprised structure which are less flexible and slower to heat and cool than would normally be preferred.

OBJECTS AND FEATURES OF THE INVENTION

It is an object of our invention to provide an improved flexible industrial electric blanket heater which is fast to heat and to cool; is extremely easy to flex and to conform with related work; and which is such that it prevents flexing and bending of the resistance element or elements which are a part thereof, beyond their elastic limits and in such a manner as is likely to cause premature work-hardening and/or breaking of the element or elements.

It is an object and feature of our invention to provide a flexible blanket heater of the general character referred to above including a thin, flexible laminated blanket structure within which an elongate flexible resistance element is positioned and which presents a minimum mass of material between and/or spaced from the elements whereby the blanket structure can be rapidly heated and cooled by the element and which requires minimum consumption of electric energy to heat it to operating temperature.

It is another object and feature of our invention to provide a heater structure of the general character referred to above including a blanket structure made sufficiently thin and flexible so that it can be manually bent, wrapped and otherwise formed about a related piece of work without undue resistance and without the presence of excessive mass and/or bulk of material which might impede convenient and effective use of the heater.

An object and feature of our invention is to provide a flexible blanket heater structure of the general character referred to above comprising a thin, normally flat, normally horizontal blanket of flexible dielectric material which has vertically spaced top and bottom planes or surfaces and defines an intermediate central plane and an elongate, flexible resistance element of flexible metal within the blanket on and extending about said central plane thereof with each portion thereof in spaced relationship from other portions thereof; the portions of the blanket adjacent to and about the element are enlarged and/or thickened to increase the mass of blanket material about and supporting the element to stiffen and limit bending of the thickened portions of the blanket so as not to bend related portions of the element beyond the elastic limit of the metal of which the element is established.

It is an object and feature of this invention to provide a heater structure of the general character referred to above including a thin, normally flat, horizontal flexible blanket structure established of a pair of adjacent, normally flat laminates of flexible dielectric blanket material and an elongate flexible metal resistance element within and supported by a jacket of flexible dielectric jacket material and positioned between said laminates with their portions adjacent said jacket in conformed engagement therewith and wherein the combined mass and/or thickness of the jacket and laminates about said element stiffen and limit bending of the heater structure adjacent to and supporting the element so that said element cannot be bent beyond its elastic limits during normal anticipated use of the heater structure.

A further object and feature of this invention is to provide the above noted heater structure wherein the shore hardness and/or thickness of the jacket and the shore hardness and thickness of the laminates are adjusted to impart the element containing and supporting portion of the structure with sufficient mass and stiffness to prevent bending and/or stretching of the element beyond its elastic limits.

Yet another object and feature of our invention is to provide the above noted heater structure wherein at least one of said laminates is provided with fabric reinforcement to impart dimensionally stability into the heater structure.

It is another object and feature of the invention to provide a heater structure of the general character referred to above wherein the top and bottom surfaces of the blanket structure are reinforced with fabric reinforcements to impart dimensional stability at those surfaces whereby the flexible and elastic dielectric material of the structure between the reinforcements is contained thereby and elastic displacement thereof is effectively limited and controlled.

Another object and feature of our invention is to provide a heater structure of the character referred to above wherein the laminates and the jacket are established of silicone rubber compound and are vulcanized together to establish an integral silicone rubber blanket structure within which the element is positioned.

Finally, it is an object and feature of our invention to vacuum form the laminates into conformed engagement with each other and with the jacket about the element when the laminates and jacket are integrated whereby the mass of laminate and jacket material about and supporting the element is substantially uniform throughout the longitudinal extent of the element.

The foregoing and other objects and features of our invention will be fully understood from the following detailed description of one typical preferred form and embodiment of our invention, throughout which description reference is made to the accompanying drawings.

DETAILED DESCRIPTION OF THE INVENTION

Figure 1:
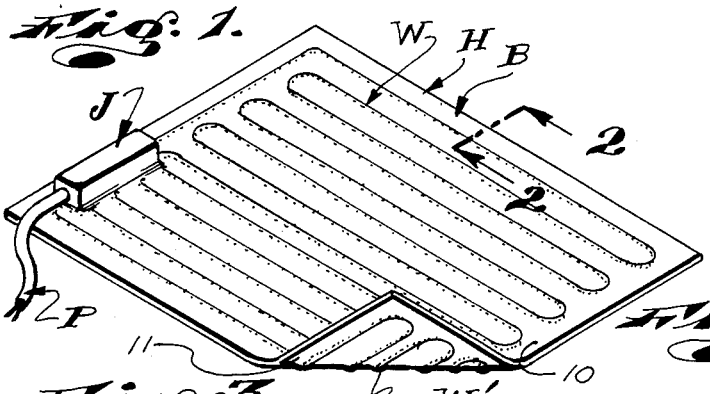
FIG. 1 is an isometric view of a heater embodying our invention.
Figure 2:
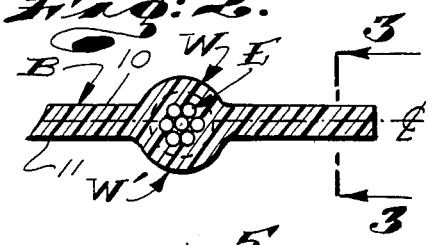
FIG. 2 is an enlarged sectional view of a portion of the heater structure shown in FIG. 1 and taken substantially as indicated by line 2—2 on FIG. 1.
Figure 3:
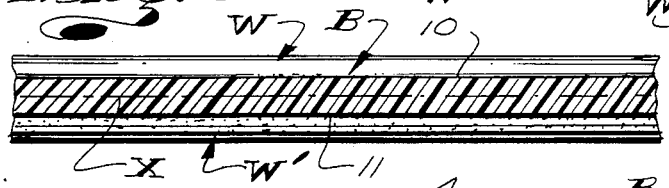
FIG. 3 is a view taken as indicated by line 3—3 on FIG. 2.

Referring to FIG. 1 of the drawings, the flexible blanket resistance heater H that we provide is shown as including a thin, substantially flat, horizontal, flexible blanket structure B containing and supporting an elongate flexible resistance element E, an elongate, flexible power cord P to connect with a suitable electric power supply (not shown) and suitable coupling means (not shown) coupling the cord with the element E. In the case illustrated, the blanket structure B has a junction block J at one surface thereof to which the element E and cord C extend and in which the above referred to coupling means occurs.

The heater H is suitable to be engaged about a piece or section of pipe or some other piece of work which is to be heated in the course of its being used or worked upon.

In practice, the heater can include suitable temperature responsive control means. For example, a normally closed temperature responsive switching device, such as a thermostat switch (not shown) can be engaged in one end of the element E, within the blanket structure B adjacent to or beneath the junction block J.

For the purpose of this disclosure the blanket structure B is shown as a thin, normally flat, flexible, rectangular unit. The blanket B is shown and will be described as being on a horizontal plane and as having normally flat, vertically spaced, top and bottom surfaces 10 and 11, straight outside edges and as having a horizontal central plane X substantially midway between the surfaces 10 and 11.

The element E is an elongate, flexible resistance element and in accordance with common practice, is established of a suitable metal alloy. The element has terminal end portions which extend to the junction block J where they are coupled with the cord P. The remainder of the element, between the end portions thereof, occurs on and is arranged to extend about the central plane of the blanket in a desired pattern whereby all portions thereof are inpredetermined spaced relationship from each other and from the edges of the blanket. In accordance with common practice and as shown, the element is in a zig-zag or serpentine pattern.

It is to be particularly noted and it will be apparent that in practice, the plane configuration or shape of the blanket can be made to best conform to some special kind of piece of work. Further, the shape or form and the location of the junction block J and the arrangement or pattern of the element E can be varied without adversely affecting or departing from the spirit of our invention. Further, in practice, more than one element E can be carried by the blanket structure and if desired, the element or elements can be shaped, that is, they can be made so that the heat generated thereby varies, in a desired manner, throughout their longitudinal extent.

The heater structure H that we provide is unique and is visibly distinguishable from other blanket heaters provided by the prior art in that the portions of the blanket structure B immediately adjacent the element E are thicker than the other portions of the blanket structure that occur between the elements. The noted thicker portions establish elongate bead-like welts W and W' that project upwardly and downwardly from the top and bottom surfaces 10 and 11 of the blanket structure B. The noted visible welts which characterize our new heater structure are created by the unique arrangement and/or placement of the flexible, elastic material of which the blanket structure B is made and so that a sufficient mass of that material occurs in supporting engagement with and about all portions of the element E, to prevent said element from being bent beyond its elastic limits and so that the mass of flexible material of which the blanket structure is established, which is spaced from and extends between portions of the element, is sufficiently small so that it requires little energy and/or heat to quickly heat it to a desired operating temperature; so that its heat storing capacity is small and it will cool rapidly; and so that it is sufficiently thin and flexible that is does not impart excessive stiffness and/or bulk to the heater structure which might inhibit the structure being easily, quickly and conveniently manually engaged and formed about a piece of work to be heated, or removed from that piece of work, whichever the case might be.

It is to be noted that if the thickness of the blanket structure was uniform throughout its plane and was sufficiently thick and stiff to prevent being bent to an extent that the element E within it would be bent beyond its elastic limit, the whole of the blanket structure would be excessively thick, bulky and stiff for easy, quick and convenient manual flexing, bending and forming, as required in normal anticipated use of the heater structure. By reducing the thickness of the portions of the blanket structure B occurring and extending between the element supporting thickened or welted portions thereof, the overall stiffness and bulkiness of the heater structure is greatly reduced. That is, while the mass of blanket material immediately adjacent to and supporting the element E is increased to prevent bending of the element beyond its elastic limits, the remainder of the blanket structure is sufficiently thin and flexible so as not to adversely affect or limit normal bending and forming of the heater about a piece of work.

In practice, those elastic and flexible materials which are suitable for establishing the blanket structure B must be dielectric materials and are, as a general rule, inherently poor heat conductors. That is, they are slow to heat and slow to cool. As a result of the foregoing, in ordinary use of blanket heaters of the character here concerned with, work with which the heaters are related is heated adjacent to or along the lines of the resistance elements (where the elements are closest to the work) and conduction of heat from those line through the work is relied upon to heat the remainder of the work. The intermediate portions of the blanket structures of such heaters (occurring between and spaced from the elements) are not relied upon for heating purposes and in fact, serve only as heat sinks and/or heat stores which are slow and costly to heat and cool and which rob as waste generated heat. The noted intermediate portions of the blanket structures do serve as heat barriers and prevent some loss of heat from the work by radiation and also shield the work from the ambient air which would otherwise absorb heat from the work and carry it away to waste.

In accordance with the above, the noted intermediate portions of the blanket structure of blanket heaters of the class here concerned with are desirable and effective heat barriers and their existence or presence, as such, is most desirable. Their existence or presence as heat conductors and distributors is of little significance and is often detrimental. Accordingly, establishing the noted intermediate portions of heater blanket structures as thin and of as little mass as is practical, while not a common and accepted practice, has been determined to be most effective and practical in the case of many blanket heater structures.

The heater H illustrated is one embodiment of our invention which we have reduced to practice and which is being commercially produced.

The heater structure H includes a unitary blanket structure B established of top and bottom normally flat, flexible laminates L and L' of silicone rubber sheeting. The laminates L and L' are integrated by vulcanizing. The laminates L and L' are 0.025" thick and each includes a flexible fabric reinforcement F comprising a sheet of woven fiberglass fabric. The laminates L and L' establish the above noted top and bottom surfaces 10 and 11 of the blanket structure B and prior to establishing the finished blanket structure, have opposing inner surfaces 20 and 21. The flexible fabric reinforcements F are preferably embedded in the rubber defining the laminates to occur at the top and bottom surfaces 10 and 11 of the finished blanket structure and serve to impart the structure with dimensional stability, without affecting the flexibility thereof. The laminate sheet stock is of uniform thickness throughout the planes of the laminates and is of predetermined shore hardness or stiffness so that the finished blanket structure B is of suitable and desired flexibility. The silicone rubber of which the laminates L and L' are established is quite elastic and the fabric reinforcements F functions to materially limit or prevent excessive elastic flow and/or displacement of the rubber material.

The silicone of which the laminates are established is initially partially vulcanized or cured and is such that when the surfaces 20 and 21 thereof are pressed into intimate contact with each other and heated to finish curing or vulcanizing the material, they fuse and/or weld together and establish a unitary or single mass.

In accordance with the foregoing, the finished blanket structure B is a unitary elastic, flexible rubber structure which is about 0.050" thick throughout its plane, except where the resistance element E occurs and as will hereinafter be described.

The heater structure H next includes the above noted elongate flexible resistance element E and an added supporting mass of silicone rubber of the like therefor. The element E and added mass of rubber is suitably positioned within and arranged about the horizontal central plane X of the blanket structure.

In our preferred carrying out of the invention, the element E is an elongate flexible twisted wire resistance element composed of multiple strands of resistance wire. The element E is within and carried by a sheath or jacket S of silicone rubber. In the reduction to practice of our invention, the outside diameter of the jacket S is approximately 0.04".

While it is desirable that the jacket S be established of silicone rubber or of the same material which is used to establish the ramainder of the blanket structure, we have successfully reduced our invention to practice using dissimilar laminate and jacket materials. For example, we have reduced our invention to practice with laminates L and L' established of silicone rubber and with the jacket S established of Teflon. However, since the maximum safe operating temperature of Teflon is only about 400° F. and is about 100° less than the safe operating temperature of silicone rubber (which is about 500° F.) and since silicone rubber and teflon will not vulcanize together to establish an integrated mass, the use of silicone rubber to establish the jacket S is considered preferable.

It is to be noted that the thickness and/or the shore hardness of the material of which the jacket S (about the element E) is made can be varied substantially so that the jacket S supports and reinforces the element E against bending of said element beyond the elastics limits of the metal alloy of which it is made, and so that in normal bending and working of the heater structure and of the element E therein, the element E will not kink, establish a set bend, and is not subject to being prematurely work hardened.

In fabricating our heater structure H, the element E, with its jacket S, is positioned between the laminates L and L' and is arranged in a serpentine, sinuate or other desired pattern throughout that plane which is to be the horizontal central plane X of the finished heater structure. When the jacketed element is thus arranged between the laminates L and L', the laminates are formed to urge their surfaces 20 and 21 into engagement with each other and about the jacket S, with suitable pressure and all opposing engaging surfaces are bonded or welded together (vulcanized).

It will be apparent that when the laminates L and L' are pressed together and welded or vulcanized, they must conform to the jacket S and their surfaces 20 and 21 establish uniform pressure engagement about their adjacent portions of the exterior surface of the jacket S (about the element E). Upon vulcanizing or welding the foregoing assembly, the laminates L and L' become welded with the jacket S and with each other to establish a single integral unitary mass of silicone rubber.

In our new heater structure, opposite terminal end portions of the element E (not shown) are arranged to extend to one predetermined portion of the blanket structure B where access to said end portions of the element can be had, as by establishing an access opening in the blanket at the top surface thereof. The end portions of the element E are suitably connected with related conductors of the above noted power cord P by suitable coupling means (not shown). In accordance with common practice, the coupling means, cord, conductors, end portions of the element, and the access opening in the blanket are encapsulated in and/or sealed by the previously noted junction block J, which can be established of silicone rubber, welded or bonded to the blanket structure B to form an integral part thereof.

Since the parts and structure employed to connect the element E with a source of electric power can vary widely in practice without in any way altering or affecting the novelty of our invention, further illustration and/or detailed description of such parts and structure will be dispensed with.

In accordance with the above, in the following we will linit this disclosure to those parts and portions of our heater structure H which embody the novel features of our invention.

When fabricating our new heater structure H, the laminates L and L' are loosely arranged in stacked relationship with the element E and its jacket S arranged therebetween. The laminates are then drawn into pressure engagement with each other and into the conformed pressure engagement about the jacket S by a suitable vacuum process, that is, by evacuating the air from between the laminates. By using such a vacuum forming process, about 15 psi (one atmosphere) of pressure is uniformly applied at and/or between all of the surfaces to be welded or bonded together. The application of mechanically applied forces onto and through the related parts, which is liable to cause the rubber to flow and the element E to be displaced from the central plane X of the finished heater is avoided.

Figure 8:
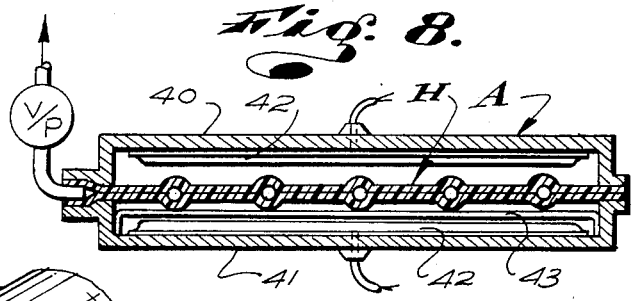
FIG. 8 is a diagrammatic view showing apparatus used to fabricate the heater structure.
Figure 7:
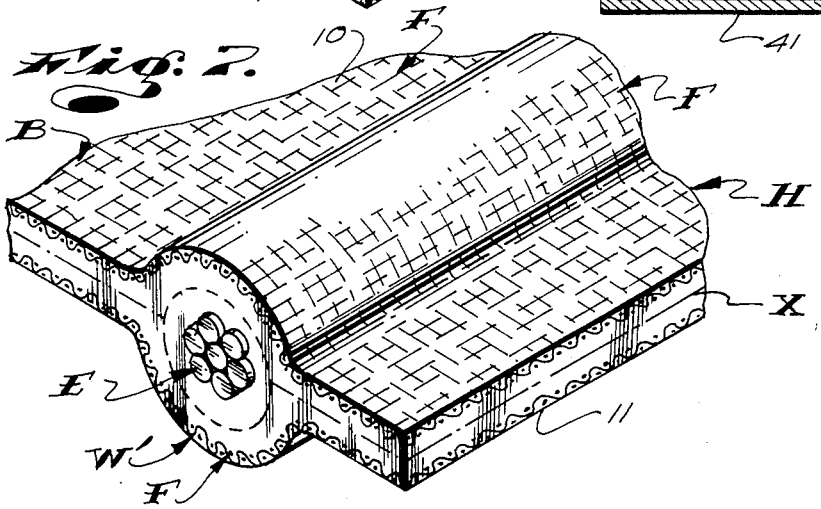
FIG. 7 is a view similar to FIG. 6 showing the parts in conformed relationship with each other.

In FIG. 8 of the drawings, we have diagrammatically illustrated a vacuum forming and vulcanizing apparatus A which might be effectively used in fabricating our new heater. The apparatus includes a box-like oven O with separable top and bottom sections 40 and 41 between which the heater assembly is arranged and within which resistance heater units 42 are positioned. The rims of the sections 40 and 41 sealingly clamp the edge portions of the laminates L and L' together. A vacuum pump V is suitably connected with the space between the laminates L and L' at one side thereof, at the exterior of the oven O. A suitable shelf 43 is positioned in the lower section of the oven to support the heater assembly. In operation, the pump V evacuates air from within the assembled heater parts, urging the parts into conformed engagement with each other and the heater units 42 heat the oven and assembled heater structure parts therein and cause them to bond or weld together and establish a unitary heater structure. In practice, with the materials that we use, a temperature of 350° F. is effective to bond and/or weld the heater parts together.

It is to be understood that the oven O and vacuum pump P shown in FIG. 8 of the drawings and briefly described above is only intended to illustrate one type and/or class of vacuum forming and heating apparatus that can be advantageously used in fabricating our new heater structure.

Figure 4:
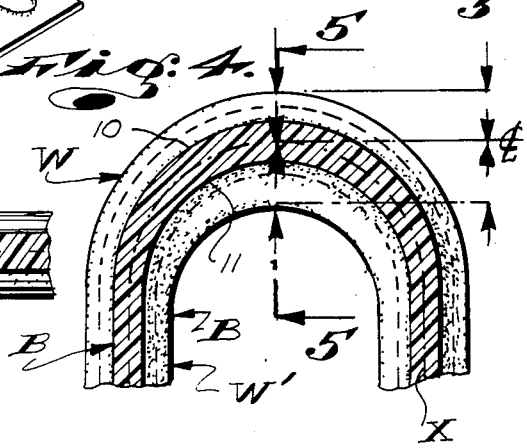
FIG. 4 is a view of the structure shown in FIG. 3 showing that structure in a bent position.
Figure 6:
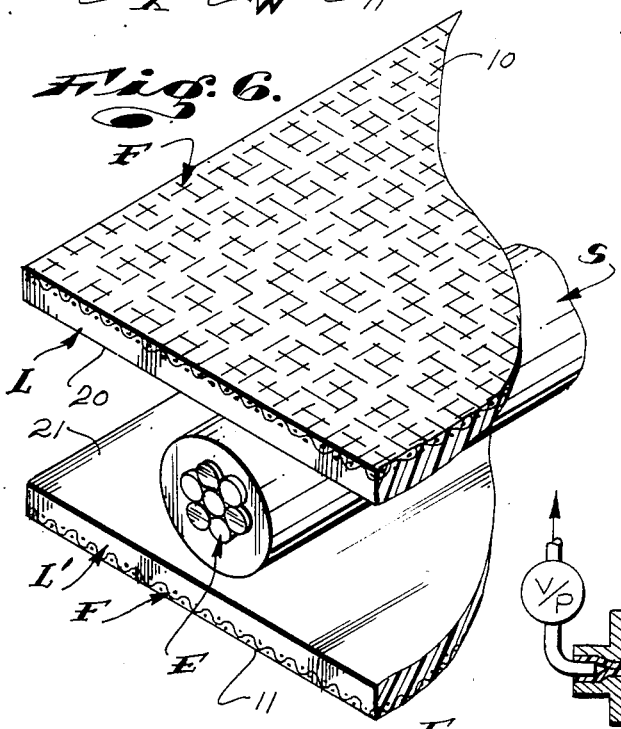
FIG. 6 is an enlarged isometric view showing portions of the heater parts related to each other preparatory to being moved into conformed engagement with each other.
Figure 5:
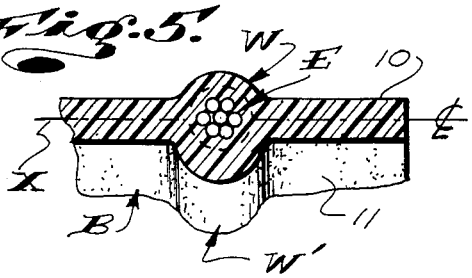
FIG. 5 is a sectional view taken substantially as indicated by line 5—5 on FIG. 4.

In accordance with the foregoing and as clearly illustrated in the drawings, our finished heater structure H is characterized by a normally flat, horizontal, very thin and highly flexible blanket structure B of heat resistant dielectric silicone rubber with vertically spaced, upwardly and downwardly disposed top and bottom surfaces 10 and 11, by an elongate flexible resistance element E in supported engagement within the blanket structure B, on the central horizontal plane X between the surfaces 10 and 11; and by elongate upper and lower reinforcing welts W and W' of said rubber, in the blanket structure B about the element E and projecting upwardly and downwardly from the top and surfaces 10 and 11. The welts W and W' reinforce and support the element E and limit flexing and bending of said element beyond its elastic limits when the blanket is bent and formed about a piece of work to be heated or when it is otherwise flexed and worked. Referring to FIG. 4 of the drawings, when the heater structure H is flexed to bend any portion of the element E, the mass of elastic rubber of the welt W about the outside radius of the bend in the wire is drawn or stretched circuferentially of the bend and is yieldingly urged radially inwardly. The rubber of the welt W' about the inside radius of the bend in the wire is yieldingly compressed circumferentially of the bend to create and increase supporting mass for the element E which limits and prevents bending of the element beyond its elastic limits. Thus, the element E can be bent to but not bent beyond its maximum safe extent, while flexing and bending of the remainder of the blanket is not restricted or limited to any appreciable extent. The overall heater structure can be bent, folded, collapsed or otherwise formed in substantially any desired manner and extent without damage to the element E.

In furtherance of our invention, the above noted fabric reinforcements F at the surfaces 10 and 11 of the blanket structure B and which extend about the welts W and W', in addition to imparting dimensional stability to the overall blanket structure B, work to keep, contain and/or back up the rubber defining the welts W and W' and inhibit or prevent excessive stretching and elastic displacement of the rubber of the welts when the heater structure is worked and bent. Due to the fabric reinforcements F about the outside radius of a bend in the heater structure, circumferntial stretching of the rubber about the outer portion of such a bend is prevented and that rubber material which is yieldingly displaced is urged and caused to move radially inwardly relative to the bend and into pressure supporting engagement with or about the element E. Due to the fabric reinforcement about the inside radius of such a bend, free or uncontrolled compressive displacement of the rubber of blanket structure about the inside portion of the bend is prevented. Instead, the compressed mass of rubber at the inside radius of such a bend is effectively contained relative to the element E, to establish a radiused or curved compacted and stiffened supporting mass of rubber about which the element E is bent and which limits the extent to which said element can be bent.

We have made a number of different sizes and shapes of flexible blanket heater structures embodying our invention with different heat out put ratings and for various special uses. In those heaters, different sizes of resistance elements, established of different alloys and having different elastic limits, have been employed. To meet special requirements, the thickness of the laminates making up different blanket heater structures, the shore hardness and/or stiffness of the materials establishing those laminates, the thickness and/or outside diameter of the jackets S about the elements E and the stiffness or shore hardness of the material of which the jackets S are established have all been varied in order to effectively limit bending of the elements, as desired, and at the same time imparting the overall blanket structures with desired flexibility. In each such heater structure, the overall mass and the heat storing capacity of the blanket structures was maintained at a minimum. When establishing those other heater structures, it was determined that to establish such heaters to attain the desirable ends afforded by our invention, it is not practical to calculate and predetermined what the relative proportioning and structural characteristics of the parts and materials might or should be. It was determined that in practice, the various necessary physical parameters of each different size, shape and output of heater can best and most practically be determined and/or arrived at by emperical testing of a series of prototype heaaters in which certain parameters of each successive prototype is adjusted in light of the results attained by each preceding prototype. Such a procedure, while appearing to be troublesome and somewhat uncertain, is in fact far less troublesome, quicker and more certain that to attempt to engineer and calculate what the relative parameters might be.

In accordance with the foregoing, it will be apparent that we provide a new and improved flexible electric resistance blanket heater including a flexible blanket structure of elastic dielectric blanket material and an elongate flexible resistance element of an alloy which is notably less elastic than the blanket material and which is positioned within and caried by the blanket structure; wherein the blanket structure has thick and thin portions of lesser and greater flexibility adjacent to and spaced from said element; the thick, less flexible portions of the blanket structure yieldingly support and prevent bending of the element beyond its plastic limits and the thin portions of greater flexibility impart greater flexibility into the whole of the heater and materially limit the mass and heat storing capacity of the heater, so that minimum energy is required to heat it to desired operating temperature, so that it is fast to heat and fast to cool, and so that the overall weight and relative cost to the heater is maintained at a minimum.

Having described our invention, we do not wish to be limited to the specific details herein set forth but wish to reserve to ourselves any modifications and/or variations that might appear to those skilled in the art and which fall within the scope of the following claims:

Having described our invention, we claim:

1. A flexible blanket resistance heater structure comprising a thin, flexible, normally horizontal blanket structure of elastic dielectric material having a normally horizontal central plane and substantially flat top and bottom surfaces spaced above and below said central plane, an elongate flexible resistance element of metal alloy, the modulus of elasticity of which is materially less than the modulus of elasticity of said dielectric material, said element is positioned within said blanket structure on said central plane and formed to extend about and throughout said plane with all portions thereof in horizontal spaced relationship from each other, said element has terminal end portions accessible from the exterior of the blanket structure to connect with an electric power supply, the portions of the blanket structure and spaced from the element are free to bend to radii smaller than the smallest radii to which said element can bend within the limits of the modulus of elasticity of the alloy of which said element is made; and elongate top and bottom welts of said dielectric material on and projecting upwardly and downwardly from said top and bottom surfaces of the blanket structure adjacent to and coextensive with said element, said welts have outside surfaces joined with related top and bottom surfaces, said welts establish curved, compacted, element-supporting masses of said dielectric material about the inside circumference of bends formed in the blanket structure adjacent said element and limit bending of said element beyond and modulus of elasticity of said alloy, and flexible fabric reinforcements are set within said elastic dielectric material adjacent said top, bottom and outside surfaces imparting the heater structure with planar dimensional stability and limiting elastic flow and displacement of said dielectric material about the inside circumference of bends formed in the blanket structure and to cause said supporting masses of dielectric material to compact substantially rigidly.

2. The flexible blanket resistance heater structure set forth in claim 1 wherein said blanket structure is made of top and bottom laminates of said dielectric material joined together at said central plane, said elongate element is surrounded by a jacket of elastic dielectric material joined with the dielectric material of adjacent portions of the top and bottom laminates, the dielectric material of said jacket and the adjacent portions of the dielectric material of said laminates combine to establish said welts.

3. The flexible blanket resistance heater structure set forth in claim 1 wherein said blanket structure is made of top and bottom laminates of said dielectric material joined together at said central plane, said elongate element is surrounded by a jacket of elastic dielectric material joined with the dielectric material of adjacent portions of the top and bottom laminates, the dielectric material of said jacket and the adjacent portions of the dielectric material of said laminates combine to establish said welts, said welts have radiused outside surfaces joining their related top and bottom surfaces.

4. The flexible blanket resistance heater structure set forth in claim 1 wherein said elongate flexible resistance element is composed of a multiplicity of loosely helically twisted metal wire strands and is yieldingly extensible under tensile forces.

5. The flexible blanket resistance heater structure set forth in claim 1 wherein said elongate flexible resistance element is composed of a multiplicity of loosely helically twisted metal wire strands and is yieldingly extensible under tensile forces; said blanket structure is made of top and bottom laminates of said dielectric material joined together at said central plane, said elongate element is surrounded by a jacket of elastic dielectric material joined with the dielectric material of adjacent portions of said top and bottom laminates, the dielectric material of said jacket and adjacent portions of the laminates combine to establish said welts.

6. The flexible blanket resistance heater structure set forth in claim 1 wherein said elongate flexible resistance element is composed of a multiplicity of loosely helically twisted metal wire strands and is yieldingly extensible under tensile forces; said blanket structure is made of top and bottom laminates of said dielectric material joined together at said central plane, said elongate element is surrounded by a jacket of elastic dielectric material joined with the dielectric material of adjacent portions of said top and bottom laminates, the dielectric material of said jacket and adjacent portions of the laminates combine to establish said welts, the shore hardness and stiffness of the material of which said laminates are made and which occurs adjacent said top, bottom and outside surfaces is less than the shore hardness and stiffness of the material of which said jacket is made so that the flow and displacement of material that occurs about and immediately adjacent the element is limited and is less than the flow and displacement of material at and immediately adjacent said top, bottom and outside surfaces where said blanket structure is bent.

* * * * *